US005078315A

United States Patent [19]

Floberg

[11] Patent Number: 5,078,315

[45] Date of Patent: Jan. 7, 1992

[54] CONTAINER PACKAGE AND A BLANK FOR PRODUCING THE SAME

[75] Inventor: Per Floberg, Lidingö , Sweden

[73] Assignee: Tetra Pak Holdings S.A., Pully, Switzerland

[21] Appl. No.: 660,899

[22] Filed: Feb. 26, 1991

[30] Foreign Application Priority Data

Mar. 13, 1990 [SE] Sweden ..... 9000885

[51] Int. Cl.[5] ..... B65D 5/08

[52] U.S. Cl. ..... 229/137; 229/184

[58] Field of Search ..... 229/125.42, 137, 184; 206/621.1, 621.2, 631.3

[56] References Cited

U.S. PATENT DOCUMENTS

| | | | |
|---|---|---|---|
| 630,789 | 8/1899 | Wyman | 229/137 |
| 2,390,909 | 12/1945 | Zinn, Jr. . | |
| 2,478,359 | 8/1949 | Ball . | |
| 2,652,186 | 9/1953 | Zinn, Jr. | 229/137 |
| 3,163,350 | 12/1964 | Zinn | 229/184 |
| 3,175,750 | 3/1965 | Bump | 229/184 |
| 3,581,977 | 6/1971 | Kirsky et al. . | |
| 4,428,499 | 1/1984 | Nauheimer | 229/184 |
| 4,667,873 | 5/1987 | Yasui et al. | 229/137 |
| 4,702,410 | 10/1987 | Derving | 229/137 |
| 4,785,993 | 11/1988 | Lisiecki . | |

FOREIGN PATENT DOCUMENTS

| | | |
|---|---|---|
| 2632914 | 1/1978 | Fed. Rep. of Germany . |
| 3303339 | 3/1984 | Fed. Rep. of Germany . |

*Primary Examiner*—Gary E. Elkins

*Attorney, Agent, or Firm*—Burns, Doane, Swecker & Mathis

[57] ABSTRACT

A blank for producing a packaging container for holding liquids includes several side panels connected to bottom folding panels by way of crease lines. The bottom panels include two main bottom panels, two fold-in panels and four generally triangular refold panels. The refold panels are disposed between the main panels and the fold-in panels. The blank also includes incision lines that extend between the free edges of the refold panels and sides of the fold-in panels. The incision lines are formed in pairs so as to define a tongue therebetween. During folding of the bottom panels for forming the container, the tongues are located inside the container bottom.

19 Claims, 2 Drawing Sheets

CONTAINER PACKAGE AND A BLANK FOR PRODUCING THE SAME

FIELD OF THE INVENTION

The present invention relates to a container package of the type which has four parallel side walls which, at their lower ends, are connected to a number of mutually foldable bottom panels defined by the intermediary of crease lines and comprising two main bottom panels, two fold-in panels and four triangular refold panels located between the main bottom panels and the fold-in panels. The present invention also relates to a blank for producing a container package of this type.

BACKGROUND OF THE PRESENT INVENTION

The production of container packages for liquid contents such as milk, juice or the like is normally carried out starting with blanks or webs of flexible packaging laminate. The laminate, which comprises layers of paper, thermoplastic and possibly aluminium foil, is divided, by means of crease lines, into different panels which, after folding and sealing of the material, form the different walls of the finished package or carton.

In the production of one well-known type of package, the so-called gable-top carton, the bottom is formed by means of a number of bottom panels which are folded and heat-sealed together in order to form a planar, liquid-tight bottom in the package. In the ready-folded state, the bottom construction includes, among other items, two substantially triangular bottom panels which are disposed interiorly in the package and have pointed corners directed towards one another at the central region of the bottom. In such package, it has been found that during transport, stacking or other handling of the packages these corners show a tendency to partially penetrate subjacent bottom panels in the package so that the interior thermoplastic sealing layer of these bottom panels is damaged and leakage occurs. While such leakage is not normally so serious that the contents held in the package run out, the contents may on occasion be absorbed into the subjacent layer of the packaging material so that this layer becomes soggy, discoloured and its mechanical strength becomes impaired.

Attempts have hitherto been made in the art to avoid the above-outlined problem by providing the bottom of the package with a different folding pattern, which may wholly obviate the aforementioned problem, since the interiorly located pointed corners may be dispensed with. However, this necessitates a total redesign of not only the crease line pattern and the tools which are employed for forming the crease lines, but also of those parts of the packaging machine which—in a predetermined sequence and according to predetermined movements—fold in and seal the different laminate panels which together form the bottom of the package. Moreover, it has been found in practice that the conventional bottom folding pattern offers so many advantages (in the form of simpler folding, more even bottom and, normally, also greater liquid-tightness) that this bottom design is preferred notwithstanding its drawbacks.

OBJECTS AND SUMMARY OF THE PRESENT INVENTION

One object of the present invention is, therefore, to reduce, in a substantially conventionally designed package bottom, the risk of leakage associated the pointed, interiorly located corners of the bottom panels.

A further object of the present invention is to devise a package of the above-mentioned type in which the prior art drawbacks are obviated without the need for modifying existing equipment for crease line punching or package forming.

Yet a further object of the present invention is to devise a package with a bottom construction which has greater liquid-tightness and leakproofness even when the package is exposed to jolts and vibrations during lengthy handling or transport.

The above and other objects have been attained according to the present invention in that a package for liquid contents is provided, in each one of its refold panels, with an incision line which extends between the free edge of the panel and adjacent fold-in panels.

Still a further object of the present invention is to devise a blank for producing a package for liquid contents which comprises two main bottom panels, two fold-in panels and four triangular refold panels located between the main bottom panels and the fold-in panels, wherein the blank is provided with incision lines which penetrate through the material and which extend between one free edge of the refold panels and adjacent fold-in panels.

BRIEF DESCRIPTION OF THE DRAWING FIGURES

One preferred embodiment of the package and the blank according to the present invention will now be described in greater detail hereinbelow, with particular reference to the accompanying drawing figures in which like elements bear like reference numerals and wherein.

DETAILED DESCRIPTION OF THE PREFERRED EMBODIMENT

Figure 1:
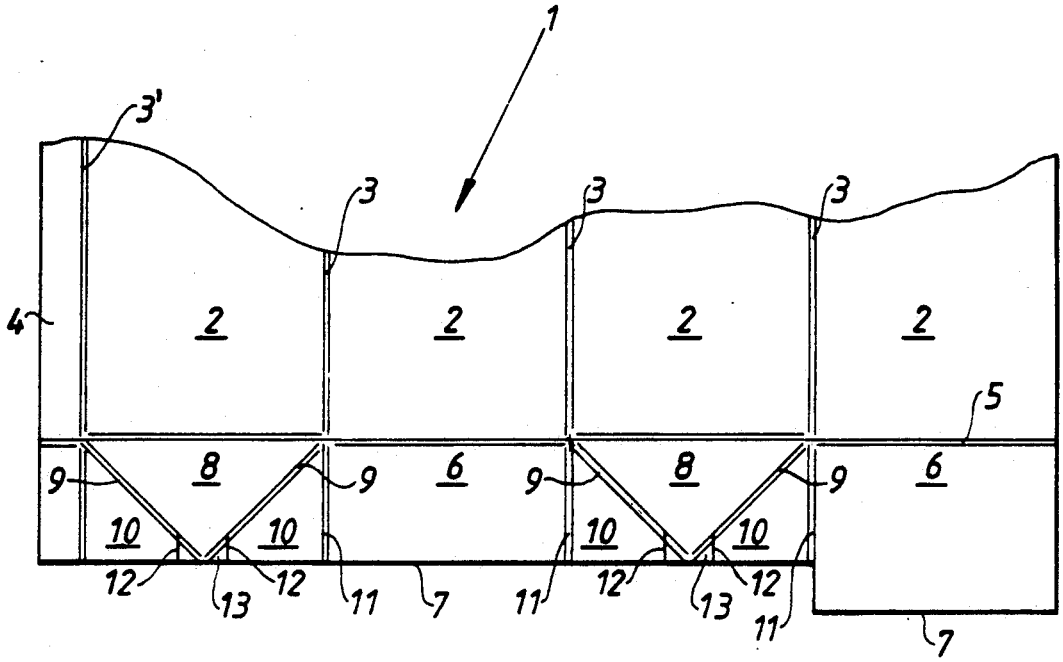
FIG. 1 is a plan view a part of a blank for a package according to according to one embodiment of the present invention in the spread-sheet state.

Consumer packages for milk, juice or the like are normally produced from a laminate material which includes a carrier layer of a fibrous material, for instance paper, which is coated on either side with thin layers of homogeneous thermoplastic material, for example polyethylene. The packaging laminate may also include additional layers of, for example, thin aluminium foil, so as to improve gas and light-tightness. Moreover, the laminate is normally provided with folding notches in the form of crease lines which divide the laminate into different panels which form walls in the finished package. In one prior art type of package, the so-called gable-top, the packaging laminate is divided into individual blanks which, after folding along the crease lines and heat-sealing with the aid of the external thermoplastic layers, form a package with a quadrilateral cross section, gable-top upper portion and planar bottom portion. A blank for such a package according to the present invention is illustrated in FIG. 1 in which, however, the upper, conventional region of the package blank which subsequently forms the gable-top of the package is not included. The illustrated package blank 1 comprises four side wall panels 2 which form side walls in the finished package and which are separated by three vertical crease lines 3. Via a fourth, vertical crease line 3', one of the two outer side wall panels 2 is united with a sealing panel 4 which, after reforming of the package blank 1 into a finished package by folding-in the vertical crease lines 3, is heat sealed in a liquid-tight manner to the outer side wall panel 2 located on the opposite side of the blank.

The ends of the side wall panels 2 are defined by a bottom crease line 5 that extends at a right angle to the vertical crease lines 3. The bottom crease line 5 extends throughout the entire width of the package blank 1 and runs substantially horizontally across a finished, upright package. Via the crease line 5, the side wall panels 2 are united with a number of bottom panels displaying a pattern of additional crease lines which make it possible, on reforming of the package blank 1 into a finished package by folding and heat-sealing, to form a liquid-tight bottom. The bottom panels include two main bottom panels 6 which are substantially rectangular and are of the same width as the adjacent side wall panels 2. Both of the main bottom panels 6 extend from the crease line 5 downwardly to the lower free edge 7 of the blank shown in FIG. 1. One of the main bottom panels 6 has an edge 7 that is spaced at a slightly greater distance from the crease line 5, and this main bottom panel will hence be of slightly greater length, making it possible to achieve, upon sealing of the bottom, an overlap seal, as is explained in greater detail below.

The two main bottom panels 6 are not located immediately adjacent one another, but instead constitute extensions of the two side wall panels 2 which surround an interjacent side wall panel. As a result, the two main bottom panels 6 will, on reforming of the package blank 1 into a finished package, be located in register with one another, will have positioned therebetween two similarly registering triangular fold-in panels 8 which constitute extensions of and are, via the crease line 5, united with both of the remaining side wall panels 2. Both of the fold-in panels 8 are in the form of isosceles triangles whose one, longer side coincides with a part of the crease line 5 which extends over the entire width of adjacent side wall panels 2. Both of the isosceles sides of the triangle meet at an apex at the free edge 7 of the blank 1. The isosceles sides of the triangle coincide with refold crease lines 9 running obliquely over the pertinent bottom panels, by the intermediary of which crease lines the fold-in panels 8 are united each with two triangular refold panels 10. In addition to the refold crease lines 9, the triangle sides of the refold panels 10 coincide with parts of the free edge 7 of the package blank 1, as well as with crease lines 11 which constitute extensions of the vertical crease lines 3 disposed between the side wall panels 2.

Figure 4:
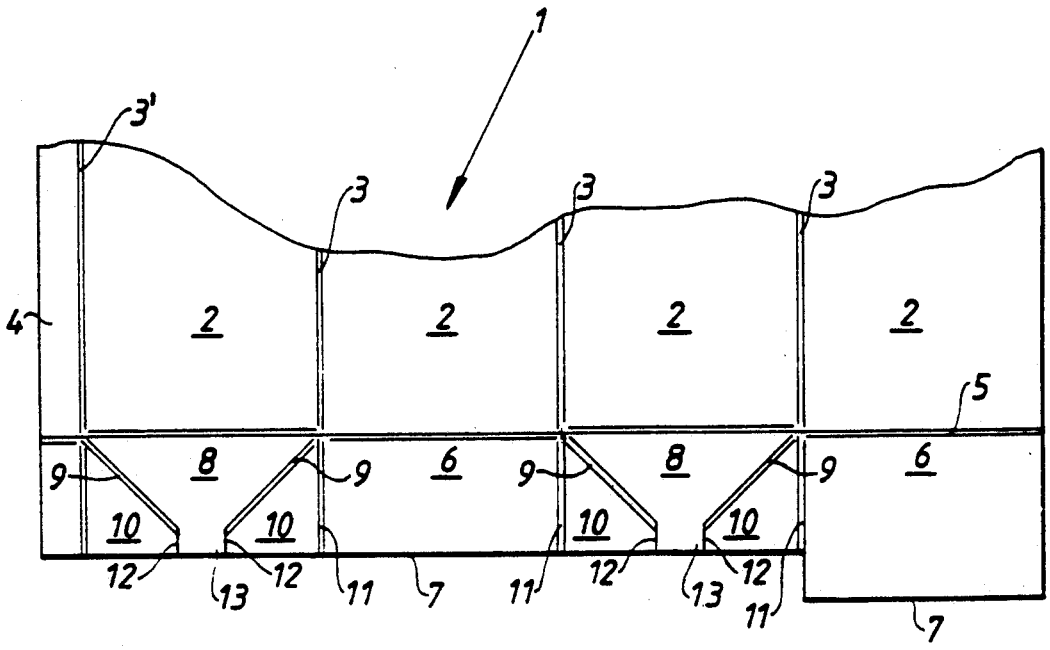
FIG. 4 is a plan view of a blank for a package according to a second embodiment of the present invention.

The package blank 1 according to the invention is further provided with a number of incision lines 12 penetrating the material, extending from the free edge 7 and located pairwise on either side of each respective fold-in panel 8 or, more precisely, symmetrically in relation to that corner of each fold-in panel 8 which is located at the free edge 7. Apart from being symmetrically located on either side of each fold-in panel, the incision lines preferably also extend pairwise in parallel, i.e. at an angle of 90° to the free edge 7. The length of each incision line is determined by the relevant distance between the free edge 7 of the blank and adjacent refold crease line 9 at that point where the incision line 12 is placed. Suitably, the mutual spacing between the incision lines 12 in each pair amounts to between 4 and 40 mm i.e. each incision line 12 is located at a distance of between 2 and 20 mm from that corner of the relevant fold-in panel 8 which is located at the free edge 7. A suitable dimension of the width of the tongue has proved to be approx. 10 mm. The above-disclosed limits are determined (4 mm) by the fact that a narrower tongue could not be formed with reliability or would not be sufficiently rigid, while an overly wide tongue (above 40 mm) would take up such a proportion of the bottom that both bottom formation and the tightness of the finished bottom would be jeopardized. In addition, it may be necessary in certain cases a to modify the conventional bottom folding devices which can otherwise be employed. There is thus formed, between each pair of incision lines 12, a tongue 13 which, in addition to the incision lines 12, is defined by a portion of the free edge 7 disposed between the incision lines, and an imaginary line which extends at right angles between the end points of the incision lines. Within this region, no folding of the packaging material takes place on reforming of the package blank 1 into a finished package, and the region preferably lacks crease lines (see FIG. 4). However, it has proved not disadvantageous if this region is nevertheless provided with crease lines in a conventional pattern and, even if the parts of the crease lines 9 located within the region of the tongue 13 are not employed, they may, hence, be retained, as shown in FIG. 1, since it is hereby possible to avoid the extra cost and labour input which would be necessary if existing creasing tools were to be rejigged or scrapped.

Figure 2:
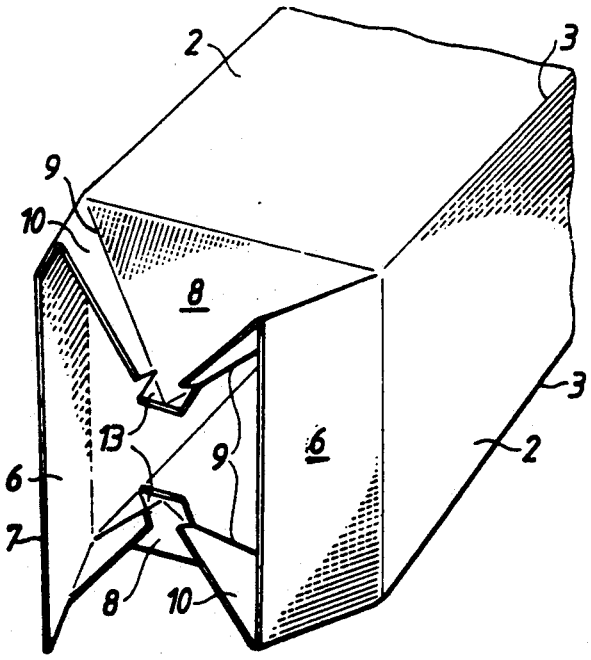
FIG. 2 is a perspective view of the lower end of a package produced from a package blank according to the invention and with partly folded bottom panels.
Figure 3:
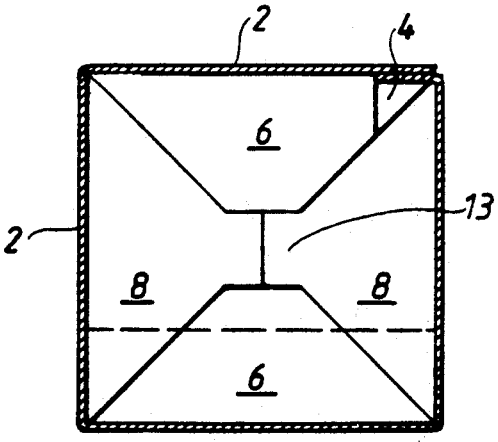
FIG. 3 is a cross-sectional view through a finished package according to the present invention.

When the package blank according to FIG. 1 is reformed into a package, a liquid-tight bottom is formed in that the different bottom panels are, after heating to a sealing temperature suitable for the thermoplastic-coated laminate, folded against one another and compressed to form a substantially planar bottom in which the bottom layers included are permanently sealed to each other when the thermoplastic has re-cooled. The folding pattern is illustrated in FIG. 2, in which the inward folding is commenced in that both of the mutually facing main bottom panels 6 are partly folded towards one another along associated parts of the bottom crease line 5, at the same time as both of the interjacent, triangular fold-in panels 8 are correspondingly folded towards one another about associated portions of the crease line 5. Since the main bottom panels 6 and the fold-in panels 8 are united to each other via the interjacent refold panels 10, these will, as is apparent from FIG. 2, be folded in between the main bottom panels 6 and the fold-in panels 8 so that a bottom is created which comprises both of the exterior, partly overlapping main bottom panels 6, the fold-in panels 8 extending along the bottom interiorly in the package, and the invisible refold panels 10 located between the fold-in panels 8 and the main bottom panels 6. In this per se conventional bottom folding operation, the material tongues 13 realized according to the present invention by means of the incision lines 12 will, in the planar state, accompany the fold-in panels 8 and maintain a planar position in the extension thereof. In such instance, the tongues 13 (FIG. 3) will be located in register with one another on the inside of the package, where they substantially meet (or even partly overlap) and are sealed in a liquid-tight manner against the bottom, and possibly to one another. Naturally, the length of the tongues may be varied as desired already on production of the blank so that the necessary degree of overlap is obtained. Alternatively, overlapping tongues may wholly be avoided in that the tongues are made shorter, i.e. do not reach the adjacent parts of the free edge line 7 of the blank, but terminate between 1 and 3 mm short of this edge. This obviates the eventuality that the tongues come into conflict With one another and may possibly be damaged on forming and sealing of the bottom. After the bottom forming operation, the originally triangular fold-in panels 8 will, hence, have each been provided with their tongue 13 instead of the point or tip which is located at the free edge 7 of the package blank 1, entailing that the reason for the hitherto experienced problem of leakage, i.e. the abrasion of the relatively sharp points against the inside of the main bottom panels 6 is eliminated. It will be apparent from FIG. 3 how both of the tongues 13 meet at the central portion of the package, which also implies a reduction of the variations in thickness in the bottom of the package caused by the different bottom panels, whereby the bottom may more simply and more reliably be sealed in a liquid-tight manner by compression. Despite its simplicity, the design according to the present invention affords a satisfactory solution to the problem of leakage under consideration herein, and the four incision lines 12 in each package blank 1 may readily be realized without affecting the conventional formation of the crease lines of the packaging material blank, or the reforming of the material blank into a finished package.

While this invention has been illustrated and described in accordance with a preferred embodiment, it is recognized that variations and changes may be made and equivalents employed herein without departing from the invention as set forth in the claims.

What is claimed is:

1. A container bottom for packing containers of the type that includes four side walls and a bottom, said bottom comprising: two oppositely positioned main bottom panels and two oppositely positioned substantially triangular fold-in panels, each of said main bottom panels being connected to one of the side walls by a crease line and each of the fold-in panels being connected to one of the side walls by a crease line, said two main bottom panels including first and second main bottom panels, said first and second main bottom panels having a length as measured from the side wall to which the respective main bottom panel is attached to a free end of the respective main bottom panel, said first main bottom panel having a length greater than the second main bottom panel, said first and second main bottom panels overlapping one another and overlying said fold-in panels when the panels are completely folded and sealed to jointly form the bottom so that the fold-in panels are positioned interiorly of the main bottom panels, each of said fold-in panels having a tongue positioned opposite the crease line which connects the respective fold-in panel to the respective side wall, each of said tongues having a free edge that faces in the direction of the oppositely positioned fold-in panel after the panels have been completely folded and sealed to jointly form the bottom.

2. The container according to claim 1, wherein the free edge of each of said tongue is planar.

3. The container according to claim 1, wherein each of said tongues is generally rectangular.

4. The container according to claim 1, wherein the tongues overlap one another.

5. The container according to claim 1, wherein each of said tongues includes oppositely positioned free edges.

6. The container according to claim 1, wherein the free edge of one tongue is spaced apart from the free edge of the other tongue.

7. The container according to claim 1, wherein one side of the refold panels is longer than the other sides, the longest side of the refold panels being connected to one of the fold-in panels.

8. The container according to claim 1, wherein said refold panels are connected to said second main bottom panel by way of crease lines that extend from the side wall to the free end of the second main bottom panel.

9. A container having an interior for holding liquids comprising: four side walls and a bottom, said bottom being defined by two oppositely positioned main bottom panels and two oppositely positioned generally triangular fold-in panels, each of said main bottom panels being connected to one of the side walls by a crease line and each of the fold-in panels being connected to one of the side walls by a crease line, said main bottom panels overlying said fold-in panels so that the fold-in panels are positioned on the interior side of the container with respect to the main bottom panels, each of said fold-in panels having two generally triangular refold panels connected thereto along crease lines, so that when the panels are completely folded and sealed to jointly form the bottom the fold-in panels are positioned interiorly of the main panels with the refold panels positioned between the main panels and the fold-in panels, the crease lines connecting one of the main panels to the adjacent refold panels extending from the side wall panels to a free end of the one main panel, each of said fold-in panels having a generally rectangular tongue extending therefrom and positioned opposite the crease line that connects the respective fold-in panel to the respective side wall, said rectangular tongues having a plurality of free edges.

10. The container according to claim 9, wherein the tongue extending from each fold-in panel has oppositely positioned free edges that extend toward the crease lines connecting the respective fold-in panel to the adjacent refold panels.

11. The container according to claim 9, wherein one of said main bottom panels is longer than the other main bottom panel in a direction generally perpendicular to the crease line that connects the main bottom panel to the respective side wall so that the longer main bottom panel overlaps the other main bottom panel.

12. A blank of material for producing a container for holding liquids, comprising: four side wall panels, two main bottom panels, two triangular fold-in panels and four triangular refold panels, each of said main bottom panels and each of said fold-in panels being connected to one of said side wall panels along a crease line so that said main bottom panels and said fold-in panels extend from the same end of the side wall panels, said main bottom panels and said fold-in panels alternating with one another and each of said fold-in panels having two adjacent refold panels connected thereto along a crease line, each of said refold panels having a free edge that is positioned opposite the crease line which connects the adjacent fold-in panel to the respective side wall, one of said main bottom panels being connected to two of said refold panels along crease lines that extend from the side wall panels to a free edge of the one main bottom panel, said blank of material having a plurality of incision lines formed therein that penetrate the material so that upon folding of the blank the portions of the blank situated on opposite sides of the incision lines will separate from one another, said incision lines being arranged in pairs such that the two incision lines in a pair are disposed on opposite sides of each fold-in panel.

13. The blank according to claim 12, wherein the incision lines are disposed in the refold panels, the incision lines in each pair being parallel to one another and being symmetrically disposed on opposite sides of the fold-in panels.

14. The container according to claim 12, wherein the two incision lines in each pair are spaced apart from one another by about 4 mm to 40 mm.

15. The blank according to claim 12, wherein the crease lines connecting a fold-in panel to the adjacent refold panels converge toward one another at a corner, the incision line formed in each refold panel being spaced approximately 2 mm to 20 mm from said corner defined by the converging crease lines that connect the respective refold panels to the adjacent fold-in panel.

16. The blank according to claim 12, wherein one of said main bottom panels is longer than the other main bottom panel in a direction perpendicular to the crease line connecting the respective main bottom panel to its respective side wall panel.

17. The blank according to claim 12, wherein each of said refold panels is in the shape of an isosceles triangle.

18. The blank according to claim 17, wherein each of the triangular refold panels has a side that is longer than the other sides of the refold panel, the longest side of each of said refold panels being connected to one of the fold-in panels.

19. The blank according to claim 12, wherein a free edge of said refold panels is aligned with and collinear with a free edge of said one main bottom panel.

* * * * *